US008784060B2

(12) United States Patent
Iwata et al.

(10) Patent No.: US 8,784,060 B2
(45) Date of Patent: Jul. 22, 2014

(54) CENTRIFUGAL FAN

(75) Inventors: Toru Iwata, Sakai (JP); Zhiming Zheng, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 910 days.

(21) Appl. No.: 12/679,790

(22) PCT Filed: Nov. 26, 2008

(86) PCT No.: PCT/JP2008/071365
§ 371 (c)(1),
(2), (4) Date: Mar. 24, 2010

(87) PCT Pub. No.: WO2009/069606
PCT Pub. Date: Jun. 4, 2009

(65) Prior Publication Data

US 2010/0202886 A1 Aug. 12, 2010

(30) Foreign Application Priority Data

Nov. 26, 2007 (JP) ..... 2007-304031
Nov. 19, 2008 (JP) ..... 2008-295122

(51) Int. Cl.
*F04D 29/28* (2006.01)

(52) U.S. Cl.
USPC ..... 416/185; 416/228

(58) Field of Classification Search
USPC ..... 416/182, 183, 184, 185, 186 R, 187, 416/228, 235, 237
See application file for complete search history.

(56) References Cited

U.S. PATENT DOCUMENTS

| | | | | |
|---|---|---|---|---|
| 3,147,911 | A * | 9/1964 | Clute | 416/183 |
| 5,667,360 | A * | 9/1997 | Hauser | 416/183 |
| 6,755,615 | B2 * | 6/2004 | Chapman | 415/206 |
| 8,007,240 | B2 * | 8/2011 | Sanagi et al. | 416/186 R |
| 2002/0051707 | A1 | 5/2002 | Takahashi et al. | |
| 2007/0098556 | A1 | 5/2007 | Sanagi et al. | |

FOREIGN PATENT DOCUMENTS

| | | | | |
|---|---|---|---|---|
| JP | 60-23300 | U | | 2/1985 |
| JP | 60023300 | U | * | 2/1985 |
| JP | 10-196591 | A | | 7/1998 |
| JP | 2001-115991 | A | | 4/2001 |
| JP | 2001-140789 | A | | 5/2001 |
| JP | 2001-263294 | A | | 9/2001 |
| JP | 2002-202095 | A | | 7/2002 |
| JP | 2003-206892 | A | | 7/2003 |
| JP | 2003206892 | A | * | 7/2003 |
| JP | 2005-155510 | A | | 6/2005 |
| JP | 2007-107435 | A | | 4/2007 |

* cited by examiner

*Primary Examiner* — Nathaniel Wiehe
*Assistant Examiner* — Ryan Ellis
(74) *Attorney, Agent, or Firm* — Birch, Stewart, Kolasch & Birch, LLP

(57) ABSTRACT

A centrifugal fan has a circular main plate driven and rotated by a motor rotary shaft, a plurality of blades fixed to an outer circumferential portion of the main plate and spaced apart at predetermined intervals in a circumferential direction of the main plate, and a side plate attached to ends of the blades opposite to the main plate. An air inlet port is formed at the center of the side plate. The side plate inclines outward in centrifugal directions from the air inlet port and has an arcuate cross section with a predetermined radius of curvature. A dead water region reducing space is formed between the blades and the side plate. The dead water region reducing space forms a smooth flow between the two surfaces of each blade, bringing about desirable blade performance.

12 Claims, 19 Drawing Sheets

CENTRIFUGAL FAN

TECHNICAL FIELD

The present invention relates to the structure of a centrifugal fan.

BACKGROUND ART

Patent Document 1, for example, discloses a centrifugal fan such as a turbofan having a plurality of blades, which are arranged between a main plate and a side plate (a shroud). FIGS. 31 to 34 each illustrate a turbofan employed in the indoor unit of a ceiling embedded air conditioner.

With reference to FIGS. 31 to 34, an indoor unit 1 of a ceiling embedded air conditioner has a cassette type body casing 2, which is embedded in a ceiling 3. An air inlet/outlet panel 4 is arranged at a lower surface of the body casing 2. The air inlet/outlet panel 4 is substantially flush with the ceiling 3.

A rectangular air inlet grill 5 is arranged at the center of the air inlet/outlet panel 4. A bellmouth 6 of a turbofan 11 is arranged at the backside of the air inlet grill 5 in the body casing 2. A plurality of air outlet ports 9 each having a predetermined width are formed in the air inlet/outlet panel 4 and outside the air inlet grill 5.

An air passage 10, which extends from the air inlet grill 5 to the air outlet ports 9 through the bellmouth 6, is formed in the body casing 2 along the entire circumference of the body casing 2. The turbofan 11 is suspended from a ceiling panel 2*a* of the body casing 2 through a fan motor 13. The turbofan 11 is arranged at the backside (the upper side as viewed in FIG. 31) of the bellmouth 6 in the air passage 10. The turbofan 11 has a side plate 15, which is arranged at the air inlet side. The side plate 15 of the turbofan 11 is arranged to face the bellmouth 6. An air heat exchanger 12 is arranged in the air passage 10 so as to surround the turbofan 11.

The turbofan 11 has a circular main plate (hub) 14, the side plate (a shroud) 15 having a tubular shape, and a plurality of blades (movable blades) 16, which are arranged between the main plate 14 and the side plate 15. The main plate 14 is fixed to a rotary drive shaft 13*a* of the fan motor 13. The blades 16 are arranged at predetermined blade angles and spaced apart at predetermined intervals in a circumferential direction. The side plate 15 has two opening ends having different outer diameters. One of the opening ends of the side plate 15 forms an air inlet port that guides air in centrifugal directions in an impeller. An air outlet port portion 6*c* of the bellmouth 6 is loosely arranged in an air inlet end portion 15*a* of the side plate 15. The bellmouth 6 is arranged rotatably with respect to the side plate 15 with a predetermined clearance maintained between the bellmouth 6 and the side plate 15.

After air has been drawn through the air inlet grill 5, the bellmouth 6 causes the air to smoothly flow in the centrifugal directions with respect to the air inlet end portion 15*a* of the side plate 15. Specifically, as illustrated in FIG. 31, the bellmouth 6 extends horizontally inward from an attachment portion 6*a*, which is attached to the air inlet/outlet panel 4, and extends vertically in such a manner that the diameter of the opening of the bellmouth 6 becomes smaller from upstream to downstream. The bellmouth 6 has an air inlet port portion 6*b* and the air outlet port portion 6*c*. The air inlet port portion 6*b* and the air outlet port portion 6*c* each form an airflow guide surface having a predetermined radius of curvature. The bellmouth 6 has an arcuate cross section along the airflow guide surface. Since the bellmouth 6 is shaped in this manner, the bellmouth 6 smoothly guides the air, which has drawn into the turbofan impeller, in the centrifugal directions with respect to the side plate 15 of the turbofan impeller. This minimizes the fan noise caused by air. As has been described, in the centrifugal fan such as the turbofan, the airflow guide surfaces of the bellmouth 6 and the side plate 15 are formed to have ideal shapes so as to reduce air turbulence occurring in an outer circumferential portion or an inlet portion of the impeller, thus reducing the noise caused by the air.

In a configuration disclosed in Patent Document 2, in order to improve the air blowing performance, only an end of a leading edge 16*a* of each blade 16 close to the side plate 15 is inclined in the rotating direction of the blade 16. This prevents separation of the airflow produced on a negative pressure surface at an inlet of the blade 16.

However, as illustrated in FIG. 35, the side plate 15 disclosed in Patent Document 1, which is shown in FIGS. 31 to 34, has an arcuate cross section having a predetermined radius of curvature, which extends from the air inlet end portion 15*a* to an air outlet end portion 15*b*. The arcuate surface extending from the leading edge 16*a* of each blade 16 to a trailing edge 16*b* of the blade 16 is slightly twisted. The blade 16 extends linearly from the main plate 14 in the vertical direction. Accordingly, an extremely small sharp corner area having a V-shaped cross section is formed between the inner arcuate surface (the airflow guide surface) of the side plate 15 and the blade 16. The corner area forms a dead water region, which is a factor decreasing the speed of the airflow. This deteriorates the original performance of each blade 16. The problem cannot be solved even by inclining only the leading edge 16*a* of the blade 16 in the rotating direction as described in the configuration disclosed in Patent Document 2.

Patent Document 1: Japanese Laid-Open Patent Publication No. 2001-115991

Patent Document 2: Japanese Laid-Open Patent Publication No. 10-196591

SUMMARY OF THE INVENTION

Accordingly, it is an objective of the present invention to provide a centrifugal fan that brings about effective blade performance by forming a dead water region reducing space between a side plate and a blade and thus ensuring a sufficiently large air passage.

To achieve the foregoing objective and in accordance with a first aspect of the present invention, a centrifugal fan including a circular main plate, a plurality of blades, and a side plate is provided. The circular main plate is driven and rotated by a motor rotary shaft. The blades are fixed to an outer circumferential portion of the main plate and spaced apart at predetermined intervals in a circumferential direction of the main plate. The side plate is attached to ends of the blades opposite to the main plate. An air inlet port is formed at a center of the side plate. The side plate inclines outward in a centrifugal direction from the air inlet port, and has an arcuate cross section with a predetermined radius of curvature. A dead water region reducing space is formed between the blades and the side plate.

In this configuration, the dead water region reducing space is formed between the airflow guide surface of the side plate and the pressure surface of each blade. This ensures a sufficiently large air passage between the side plate and the blades. A smooth airflow is thus formed on both surfaces of each blade. Accordingly, formation of a dead water region is prevented, and the blade performance is improved.

In accordance with a second aspect of the present invention, a centrifugal fan including a circular main plate, a plurality of blades, and a side plate is provided. The circular main plate is driven and rotated by a motor rotary shaft. The blades are fixed to an outer circumferential portion of the main plate and spaced apart at predetermined intervals in a circumferential direction of the main plate. The side plate is attached to ends of the blades opposite to the main plate. An air inlet port is formed at a center of the side plate. The side plate inclines outward in a centrifugal direction from the air inlet port, and has an arcuate cross section with a predetermined radius of curvature. The blades are joined to the side plate in such a manner that the size of an air passage formed between one surface of each blade and the side plate becomes substantially equal to the size of an air passage formed between the other surface of the blade and the side plate, thereby forming a dead water region reducing space between the blade and the side plate.

In this configuration, sufficiently large air passages with uniform dimensions are formed on both surfaces of each blade at a joint portion between the blade and the side plate. This forms a smooth airflow on both surfaces of the blade. Accordingly, formation of a dead water region is prevented, and the blade performance is improved.

In accordance with a third aspect of the present invention, a centrifugal fan including a circular main plate, a plurality of blades, and a side plate is provided. The circular main plate is driven and rotated by a motor rotary shaft. The blades are fixed to an outer circumferential portion of the main plate and spaced apart at predetermined intervals in a circumferential direction of the main plate. The side plate is attached to ends of the blades opposite to the main plate. An air inlet port is formed at a center of the side plate. The side plate inclines outward in a centrifugal direction from the air inlet port, and has an arcuate cross section with a predetermined radius of curvature. A portion of each blade is bent in a direction opposite to a rotating direction. The blade is joined to an arcuate surface of the side plate with the bent portion, thereby forming a dead water region reducing space between the blade and the side plate.

In this configuration, a sufficiently large air passage is formed between the airflow guide surface of the side plate and the pressure surface of each blade. A smooth airflow is thus formed on both surfaces of the blade. Accordingly, formation of a dead water region is prevented, and the blade performance is improved.

In the above centrifugal fan, it is preferable that, in a plane including the motor rotary shaft, each blade be joined to the arcuate surface of the side plate in such a manner that a midline of the blade extending from the main plate to the side plate is substantially perpendicular to a tangential line of the arcuate surface of the side plate. In this case, sufficiently large air passages with uniform dimensions are formed on both surfaces of each blade at the joint portion between the blade and the side plate. This forms a smooth airflow on both surfaces of the blade. Accordingly, formation of a dead water region is prevented, and the blade performance is improved.

In the above centrifugal fan, it is preferable that, in the plane including the motor rotary shaft, the bent portion of each blade be formed as a curved portion projecting in the direction opposite to the rotating direction with respect to a straight line extending from a joint point between the blade and the main plate and along the motor rotary shaft. In this case, unlike a case in which the end of each blade close to the side plate is simply bent and inclined in the direction opposite to the rotating direction of the blade, the air blowing performance is effectively improved without changing the joint position or the joint width between each blade and the side plate. This minimizes the influence on the original air blowing characteristics of the blade and facilitates the design of the blade.

In the above centrifugal fan, it is preferable that the bent portion be arranged at a position close to the side plate with respect to the middle between the main plate and the side plate. In this case, compared to a case in which the bent portion is arranged at a position close to the main plate with respect to the middle between the main plate and the side plate, the air passage is enlarged by bending each blade to a smaller extent. This maintains the original air blowing characteristics of the blade. Accordingly, the air blowing performance is further effectively improved.

In the above centrifugal fan, it is preferable that each blade have a leading edge and a trailing edge, that the blade be arranged with the leading edge facing the center of the main plate and the trailing edge facing an outer circumference of the main plate, and that an attachment position of the trailing edge of the blade to the side plate be offset from an attachment position of the trailing edge of the blade to the main plate in the direction opposite to the rotating direction. In this case, the wind speed distribution is uniformized at the outlet portion of each blade. Accordingly, not only the air blowing performance is improved by forming the dead water region reducing space using the bent portion, but also the fan noise is effectively reduced.

In the above centrifugal fan, it is preferable that each blade have a leading edge and a trailing edge, that the blade be arranged with the leading edge facing the center of the main plate and the trailing edge facing the outer periphery of the main plate, and that the trailing edge of the blade be gradually displaced in the direction opposite to the rotating direction from the main plate toward the side plate. In this case, the wind speed distribution is uniformalized at the outlet portion of each blade. Accordingly, not only the air blowing performance is improved by forming the dead water region reducing space using the bent portion, but also the fan noise is effectively reduced.

In the above centrifugal fan, it is preferable that each blade have a leading edge and a trailing edge, that the blade be arranged with the leading edge facing the center of the main plate and the trailing edge facing the outer periphery of the main plate, and that the trailing edge of the blade is formed in a sawtooth-like shape. This decreases the air turbulence caused by the airflows moving along the two surfaces of each blade and converging, thus effectively reducing the fan noise.

In the above centrifugal fan, it is preferable that each blade have a leading edge and a trailing edge, that the blade be arranged with the leading edge facing the center of the main plate and the trailing edge facing the outer periphery of the main plate, and that a portion of the leading edge of the blade close to the main plate be formed in a stepped shape. In this case, the airflow moving toward the leading edge of each blade becomes turbulent by hitting the discontinuous portion formed by the stepped portion. A vertical vortex in the drawn air is thus guided by the stepped surface of the stepped portion and generated in a concentrated manner on an outer peripheral surface or an inner peripheral surface of the blade. As a result, the vertical vortex develops and produces an intense energy. The thus formed vertical vortex effectively suppresses separation of an airflow produced on the outer peripheral surface or the inner peripheral surface of the blade. Accordingly, the fan noise is reliably reduced.

In the above centrifugal fan, it is preferable that each blade have a horseshoe vortex suppressing portion, that the horseshoe vortex suppressing portion be formed by curving a portion of the leading edge of the blade close to the main plate such that the portion projects in the rotating direction. In this case, the joint portion between the leading edge of each blade and the main plate is asymmetrical. This suppresses a horseshoe vortex generated at the joint portion between the main plate and the blade. Accordingly, the influence on the airflow flowing along the blade is reduced, and the air blowing performance is effectively improved.

In the above centrifugal fan, it is preferable that each blade have a horseshoe vortex suppressing portion, and that the horseshoe vortex suppressing portion be formed by curving a portion of the leading edge of the blade close to the main plate such that the portion projects in the direction opposite to the rotating direction. In this case, the joint portion between the leading edge of each blade and the main plate is asymmetrical. This suppresses a horseshoe vortex generated at the joint portion between the main plate and the blade. Accordingly, the influence on the airflow flowing along the blade is reduced, and the air blowing performance is effectively improved.

In the above centrifugal fan, it is preferable that each blade have a forward-swept blade structure, and that the forward-swept blade structure be formed by projecting a portion of the leading edge of the blade close to the main plate toward the center of the main plate. In this case, pressing force is applied from the main flow of drawn airflows to the main plate at the leading edge of each blade. This either makes it difficult for a horseshoe vortex to generate or reduces the size of the horseshoe vortex, in a synergetic manner with the action brought about by the bent structure. As a result, the influence on the airflow moving along each blade is decreased, and the air blowing performance is further effectively improved.

In the above centrifugal fan, it is preferable that each blade have a retreating blade structure, and that the retreating blade structure be formed by recessing a portion of the leading edge of the blade close to the main plate. In this case, at the leading edge of each blade, pressing force is applied from a main airflow, the speed of which has been increased after the air has been drawn, to the main plate. This either makes it difficult for a horseshoe vortex to generate or reduces the size of the horseshoe vortex. As a result, the influence on the airflow moving along each blade is decreased, and the air blowing performance is further effectively improved.

BEST MODE FOR CARRYING OUT THE INVENTION

First Embodiment

A centrifugal fan (a turbofan) according to a first embodiment of the present invention, which is employed in an indoor unit of a ceiling embedded air conditioner, will be explained with reference to FIGS. 1 to 5.

Figure 1:
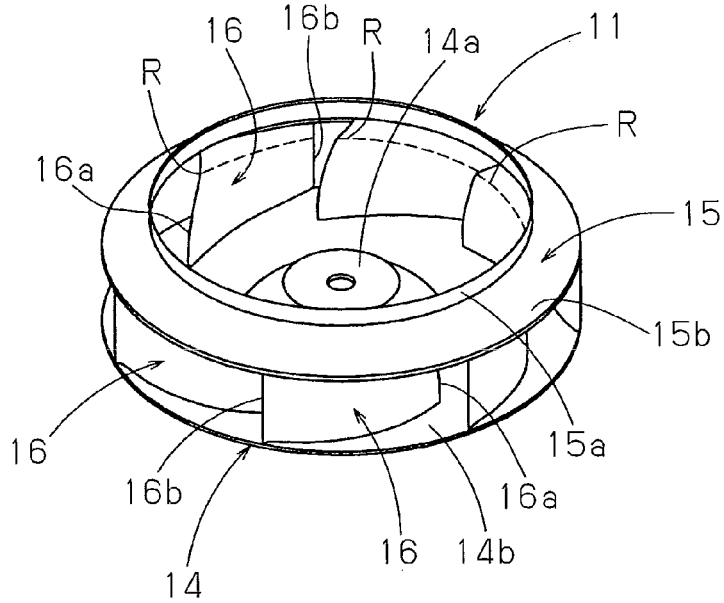
FIG. 1 is a perspective view showing the configuration of a centrifugal fan as a whole according to a first embodiment of the present invention.
Figure 2:
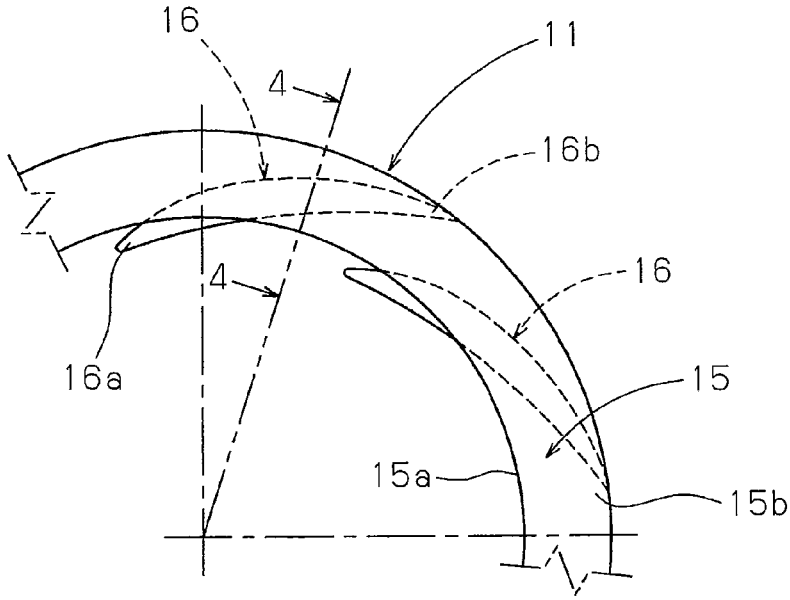
FIG. 2 is a plan view showing a portion of the centrifugal fan as viewed from a side corresponding to a side plate (a shroud)
Figure 3:
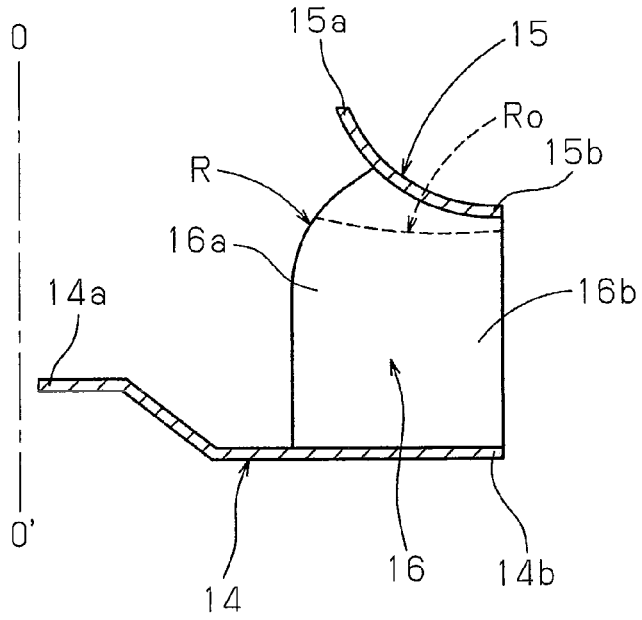
FIG. 3 is a cross-sectional view showing a portion of a blade arranged between the side plate (the shroud) and a main plate.
Figure 31:
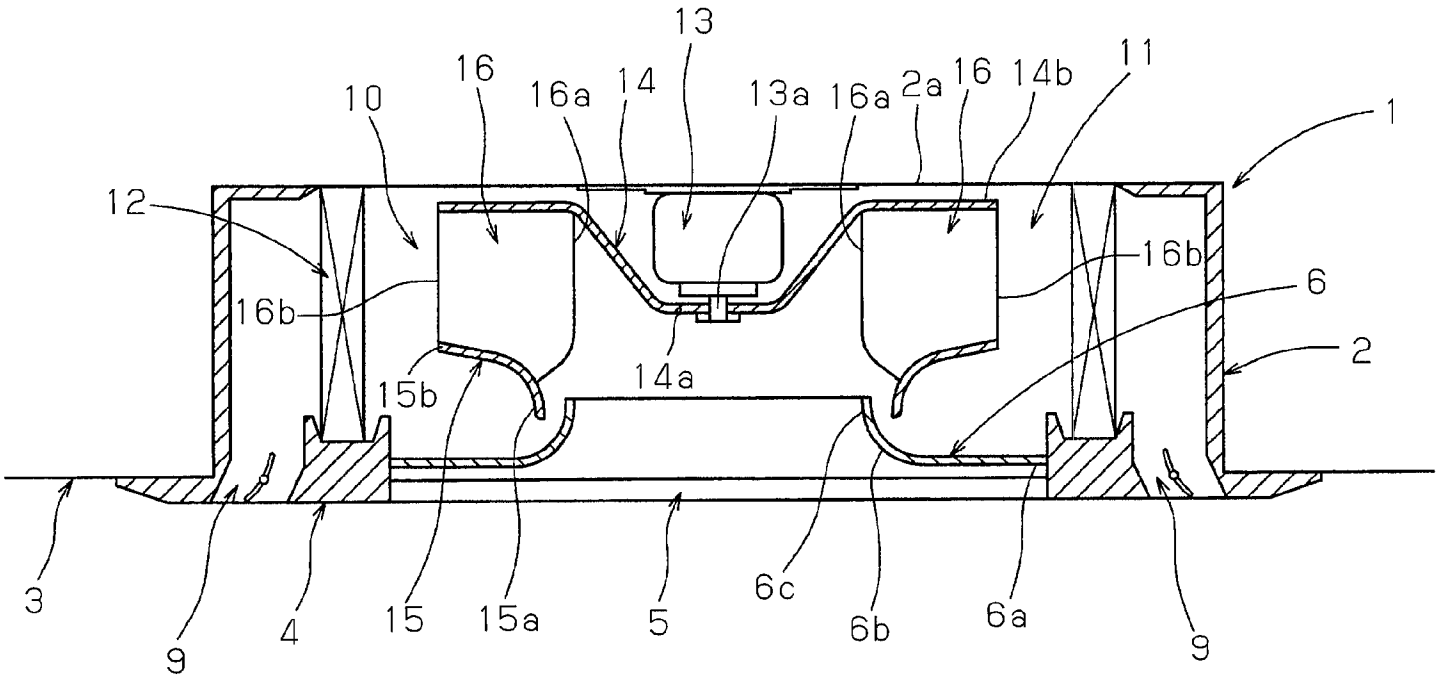
FIG. 31 is a cross-sectional view illustrating the configuration of a conventional centrifugal fan as a whole.
Figure 32:
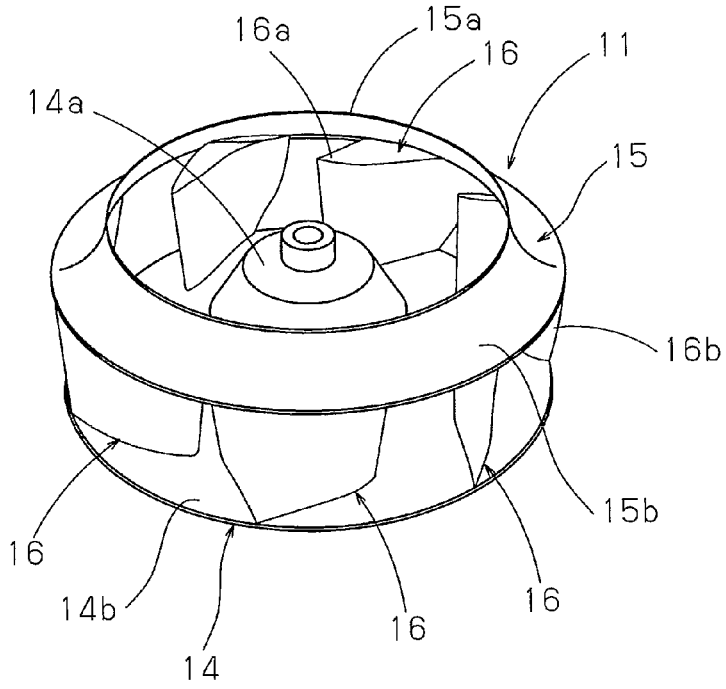
FIG. 32 is a perspective view showing the centrifugal fan.
Figure 33:
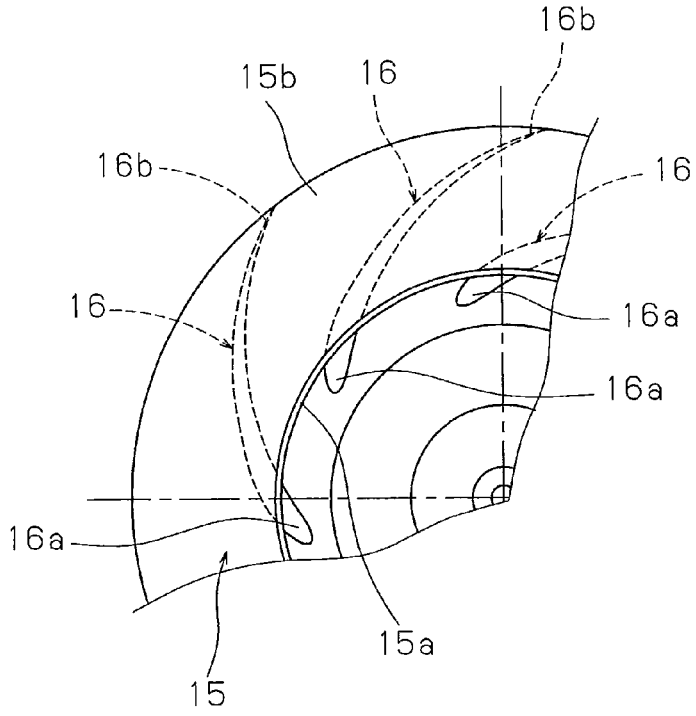
FIG. 33 is an enlarged plan view showing a main portion of the centrifugal fan.
Figure 34:
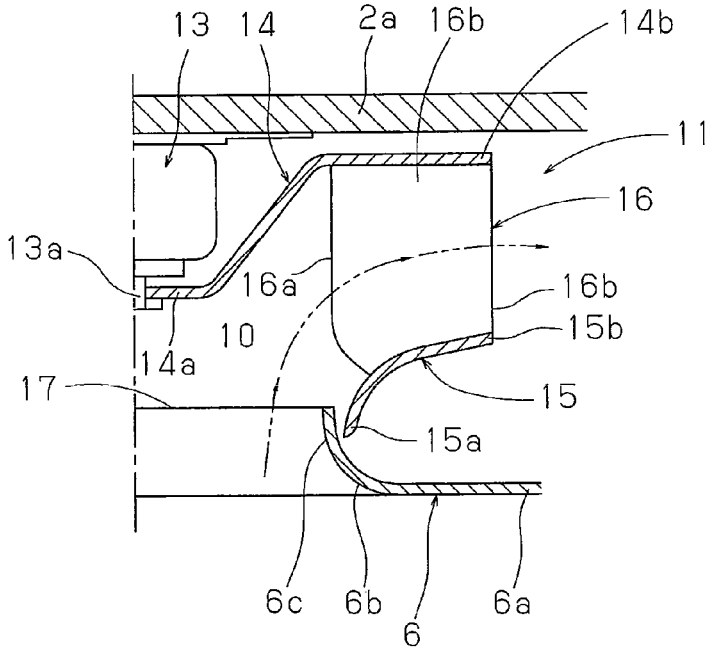
FIG. 34 is a cross-sectional view showing a portion of a blade arranged between a side plate and a bellmouth of the centrifugal fan.

As illustrated in FIGS. 1 to 3, a centrifugal fan (a turbofan) 11 has a circular main plate (a hub) 14, a tubular side plate (a shroud) 15, and a plurality of blades (rotor blades) 16, which are arranged between the main plate 14 and the side plate 15. The main plate 14 is fixed to a rotary drive shaft 13*a* of a fan motor 13 illustrated in FIG. 31. The blades 16 are arranged at predetermined blade angles and spaced apart at predetermined intervals in the circumferential direction. The side plate 15 has two opening ends having different outer diameters. One of the opening ends of the side plate 15 forms an air inlet port, which guides air in centrifugal directions in an impeller. An air outlet port portion 6*c* of a bellmouth 6 is loosely received in an air inlet end portion 15*a* of the side plate 15. The bellmouth 6 is arranged rotatably with respect to the side plate 15 with a predetermined clearance between the bellmouth 6 and the side plate 15.

The bellmouth 6 allows the air that has been drawn through an air inlet grill 5 to smoothly flow into the air inlet end portion 15*a* of the side plate 15 in the centrifugal directions. Specifically, the bellmouth 6 extends horizontally inward from an attachment portion 6*a*, at which the bellmouth 6 is attached to an air inlet/outlet panel 4, and projects vertically in such a manner that the diameter of the opening of the bellmouth 6 becomes smaller from upstream to downstream. The bellmouth 6 has an air inlet port portion 6*b* and the air outlet port portion 6*c*. The air inlet port portion 6*b* and the air outlet port portion 6*c* form an airflow guide surface having a predetermined radius of curvature. Since the bellmouth 6 is shaped in this manner, the bellmouth 6 guides the air that has drawn into a turbofan impeller smoothly in the centrifugal directions in accordance with the side plate 15 of the turbofan impeller. As has been described, in the centrifugal fan such as the turbofan, the airflow guide surfaces of the bellmouth 6 and the side plate 15 are formed to have ideal shapes in such a manner as to reduce air turbulence in an outer circumferential portion or an inlet portion of the impeller, thus decreasing the noise caused by the air and improving the air blowing performance.

Figure 35:
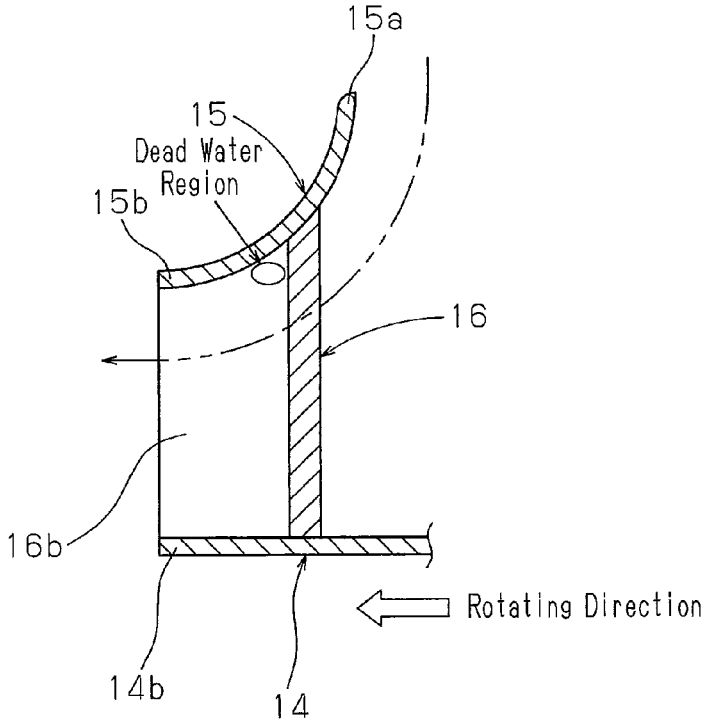
FIG. 35 is an enlarged cross-sectional view of the conventional centrifugal fan, showing a portion of a joint portion between the blade and the side plate and a portion of the joint portion between the blade and the main plate.

However, with reference to FIG. 35, a conventional side plate 15 has an arcuate cross section having a predetermined radius of curvature, which extends from an air inlet end portion 15*a* to an air outlet end portion 15*b*. An arcuate surface of each blade 16 is slightly twisted. The blade 16 extends linearly from a main plate 14 in a vertical direction. Accordingly, an extremely small sharp corner area having a V-shaped cross section is formed between an inner arcuate surface (an airflow guide surface) of the side plate 15 and the blade 16. The corner area forms a dead water region, which reduces the speed of the airflow. The blade 16 thus cannot be used effectively.

Figure 4:
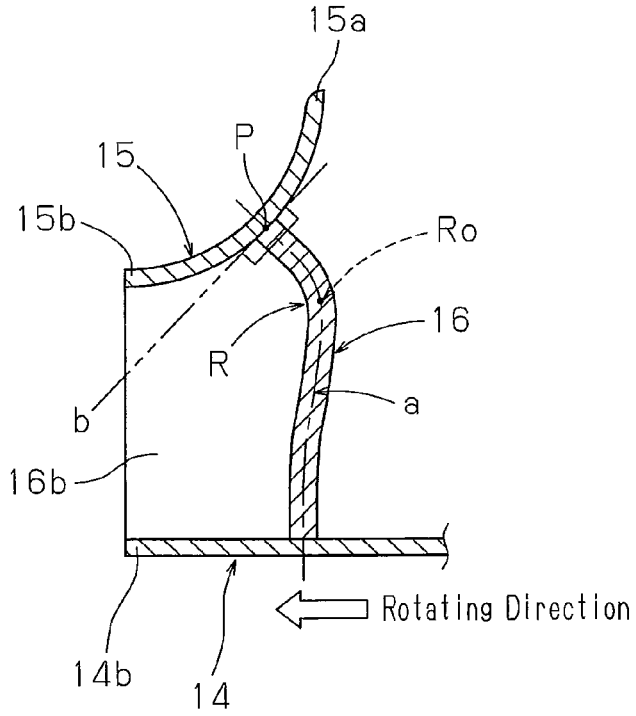
FIG. 4 is a cross-sectional view taken along line 4-4 of FIG. 2.
Figure 5:
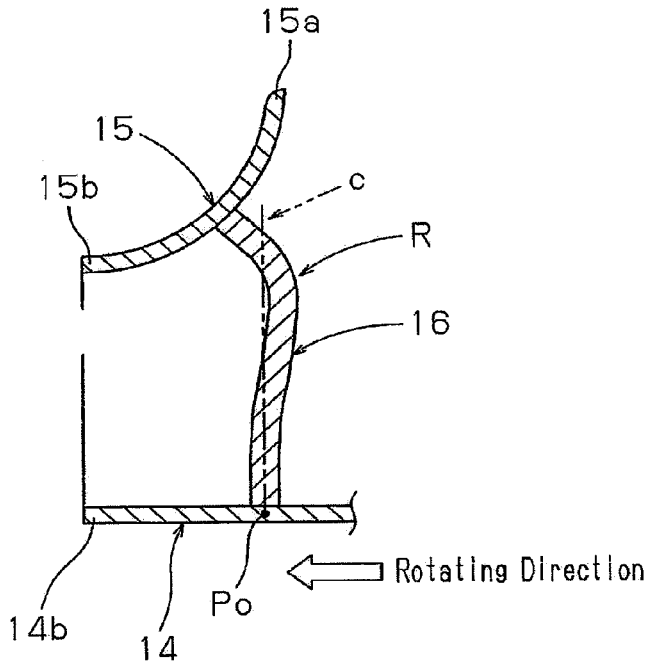
FIG. 5 is a cross-sectional view showing a portion of FIG. 4, illustrating the relationship between the curvature of the blade and a joint portion between the blade and the main plate.
Figure 6:
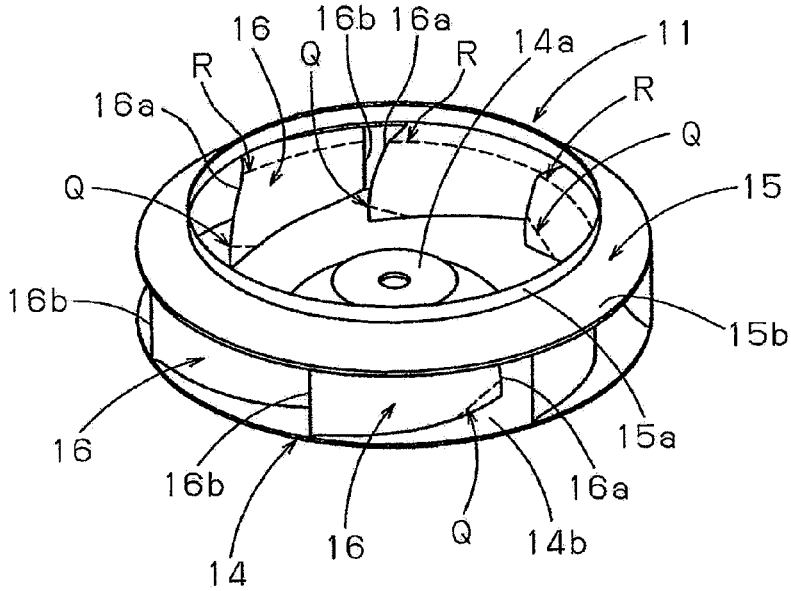
FIG. 6 is a perspective view showing the configuration of a centrifugal fan as a whole according to a second embodiment of the present invention.
Figure 7:
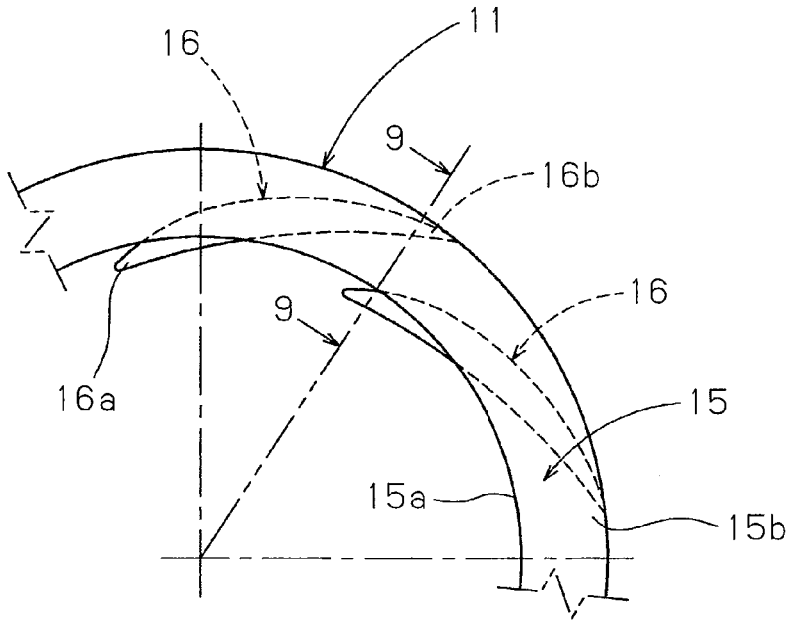
FIG. 7 is a plan view showing a portion of the centrifugal fan as viewed from a side corresponding to a side plate.
Figure 8:
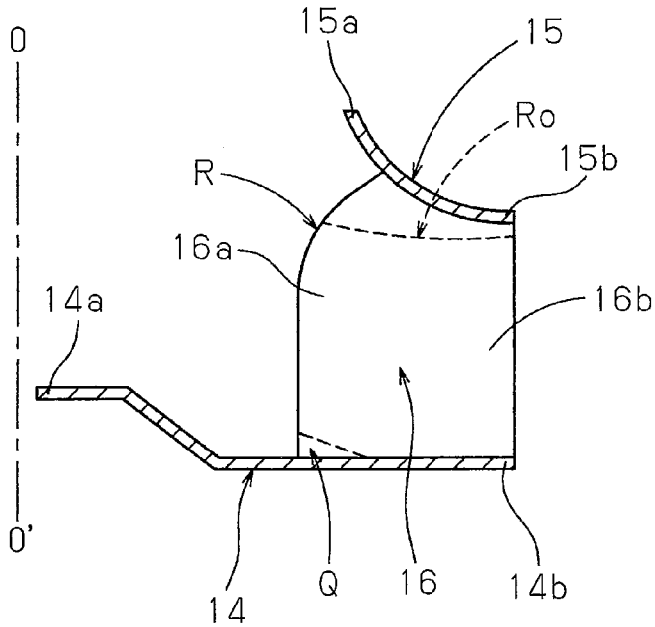
FIG. 8 is a cross-sectional view showing a portion of a blade arranged between the side plate and a main plate.

To solve this problem, in the first embodiment, a middle portion of each blade 16 is bent in the direction opposite to the rotating direction as illustrated in FIGS. 4 and 5. That is, by bending the blade 16 in the direction opposite to the rotating direction, the end of the blade 16 close to the side plate 15 is inclined toward the air inlet end portion 15*a* of the side plate 15. This creates a sufficiently large air passage between the airflow guide surface of the side plate 15 and the blade 16. Also, the blade 16 is formed integrally with the inner arcuate surface of the side plate 15. This structure exerts desirable blade performance.

In this configuration, the sufficiently large air passage is formed between the airflow guide surface of the side plate 15 and a pressure surface of each blade 16 as a dead water region reducing space. This creates smooth airflows on both surfaces of the blade 16, which receive positive pressure and negative pressure, respectively. Accordingly, the blade performance, which is the air blowing performance, is improved.

As illustrated in FIG. 4, each blade 16 is joined to the inner arcuate surface of the side plate 15. Specifically, the blade 16 is joined to the side plate 15 in such a manner that the midline a of the blade 16 extending from the main plate 14 to the side plate 15 extends substantially perpendicular to a tangential line of the inner arcuate surface of the side plate 15, which is the tangential line b including the contact point P, on a plane including the rotational axis of the fan motor.

In this configuration, sufficiently large air passages having uniform dimensions are formed on both surfaces of each blade 16 at a joint portion of the blade 16 with respect to the side plate 15. In this case, the corner area between the side plate 15 and the blade 16 has an angle of approximately 90°. This creates a smooth airflow on each surface of the blade 16, thus further improving the air blowing performance. Further, the end of the blade 16 close to the side plate 15 is inclined with respect to the side plate 15 to form a curved portion R, as illustrated in FIG. 4. The curved portion R extends from a leading edge 16*a* of the blade 16 to a trailing edge 16*b*. With reference to FIG. 5, the curved portion R projects in the direction opposite to the rotating direction with respect to a line C, which extends from the joint point PO between the blade 16 and the main plate 14 along the rotational axis O-O' of the fan motor (see FIG. 3), on a plane including the rotational axis O-O'.

Unlike the configuration in which only the end of each blade 16 close to the side plate 15 is simply inclined in the direction opposite to the rotating direction, this configuration effectively improves the air blowing performance without greatly changing the joint position or the joint width between the blade 16 and the side plate 15. Accordingly, influence on the original air blowing characteristics of each blade 16 is suppressed, and the design of the blade 16 is facilitated. It is preferable to arrange the curvature point (the maximum projection point) RO of the curved portion R, which is formed in each blade 16, at a position close to the side plate 15 with respect to the middle between the main plate 14 and the side plate 15.

In this manner, compared to a case in which the curved portion R is arranged at a position close to the main plate 14 with respect to the middle between the main plate 14 and the side plate 15, the air passage is enlarged by the curved portion R with a smaller curvature. This provides a low-cost air conditioner that suppresses noise caused by the air and has a high air blowing performance.

Second Embodiment

A centrifugal fan according to a second embodiment of the present invention, which is used in an indoor unit of a ceiling embedded air conditioner, will now be described with reference to FIGS. 6 to 10.

As illustrated in FIGS. 6 to 10, the second embodiment has an additional curved portion formed close to the joint portion between each blade 16 and the main plate 14 of the centrifugal fan according to the first embodiment. This suppresses a horseshoe vortex produced on each surface of the blade 16 at the joint portion between the blade 16 and the main plate 14.

Figure 36:
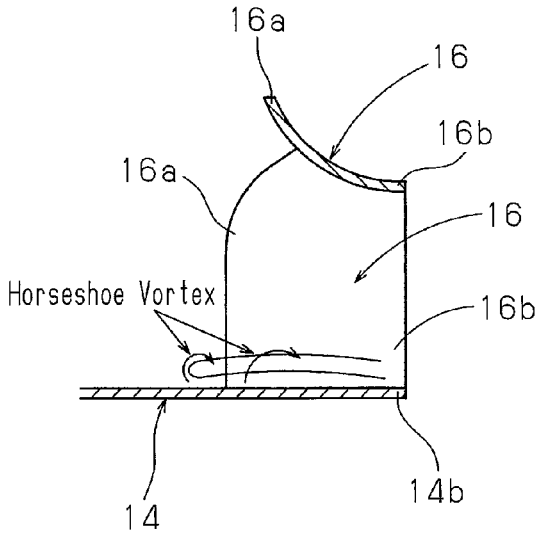
FIG. 36 is a cross-sectional view showing a portion of the joint portion between the blade and the main plate and illustrating operation of the joint portion.
Figure 37:
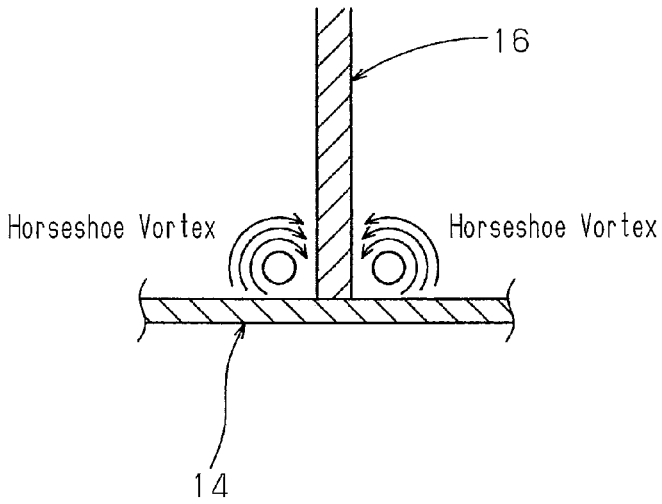
FIG. 37 is a vertical cross-sectional view illustrating a problem of a centrifugal fan blade.
Figure 38:
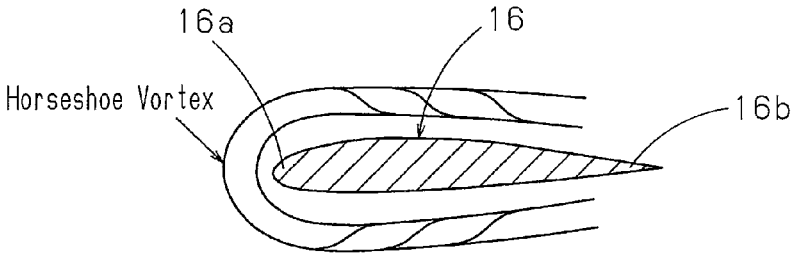
FIG. 38 is a horizontal cross-sectional view illustrating the problem of the centrifugal fan blade.

With reference to FIGS. 36 to 38, when each blade 16 extends perpendicular to the flat main plate 14 as in the case of the first embodiment illustrated in FIGS. 1 to 5, a horseshoe vortex is produced around the position at which the main plate 14 and the leading edge 16*a* of the blade 16 cross each other. As the horseshoe vortex is generated and increased, the original airflow moving along the blade 16 is interrupted. This lowers the air blowing performance of the blade 16.

To solve this problem, as illustrated in FIGS. 6 to 10, the second embodiment includes a curved projecting surface portion Q, which is formed at the leading edge 16*a* of each blade 16 joined to the main plate 14, that is, the portion of the blade 16 close to the main plate 14. The curved projecting surface portion Q is formed by inclining the leading edge 16*a* of the blade 16 in the rotating direction with reference to the portion represented by the broken lines in FIGS. 6 and 8. In other words, with reference to FIGS. 9 and 10, the curved projecting surface portion Q is formed by projecting a portion of the leading edge 16*a* of each blade 16 close to the main plate 14 in the direction opposite to the rotating direction. The joint portion between the leading edge 16*a* of the blade 16 and the main plate 14 is shaped asymmetrically on the right and left sides of the joint portion as viewed in FIG. 10, which are a positive pressure surface and a negative pressure surface. This suppresses a horseshoe vortex produced at the joint portion between the main plate 14 and each blade 16, thus improving the air blowing performance of the blade 16.

Figure 9:
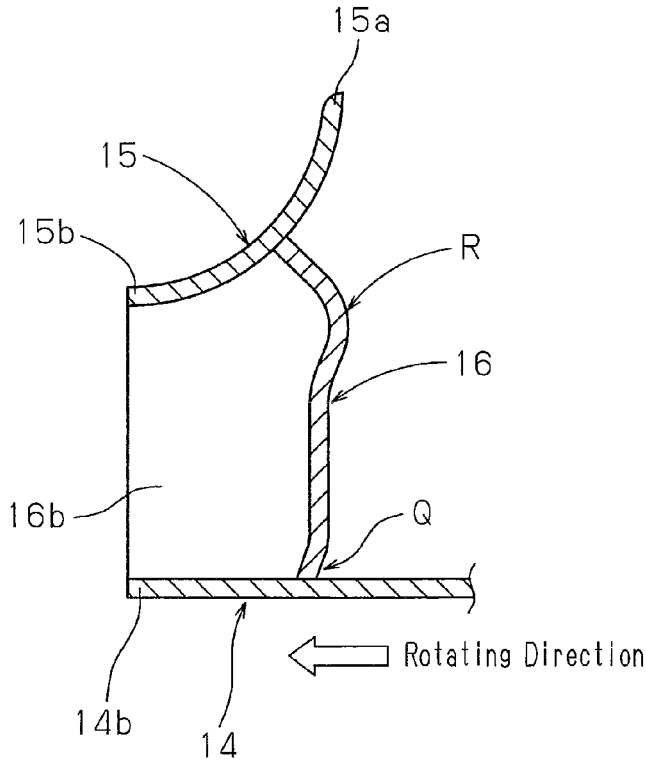
FIG. 9 is a cross-sectional view taken along line 9-9 of FIG. 7.
Figure 10:
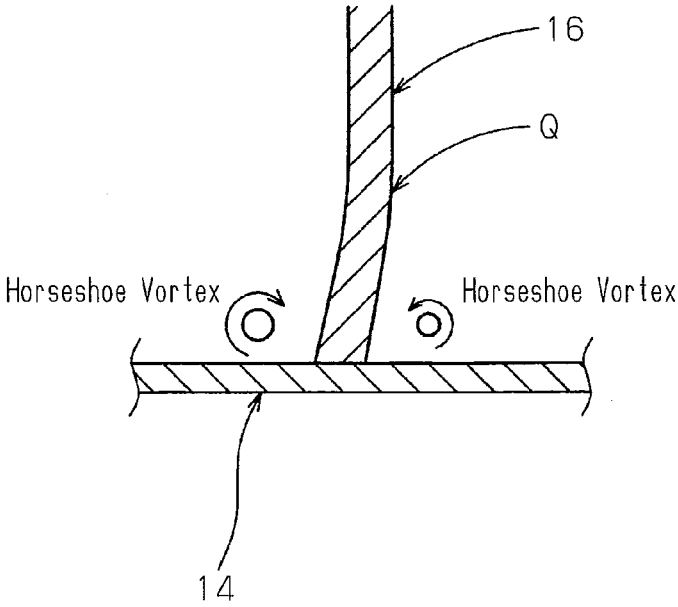
FIG. 10 is an enlarged cross-sectional view showing a portion of FIG. 9 and illustrating the curvature of the blade and a joint portion between the blade and the main plate.

As has been described, in the second embodiment, the curved projecting surface portion Q, which projects in the direction opposite to the rotating direction, is formed at the leading edge 16*a* of each blade 16 by inclining the leading edge 16*a* of the blade 16 close to the main plate 14 in the rotating direction. In this manner, the joint portion between the leading edge 16*a* of the blade 16 and the main plate 14 is shaped asymmetrically. The curved projecting surface portion Q thus functions as a horseshoe vortex suppressing portion. With reference to FIGS. 9 and 10, the centrifugal force generates force that acts on the negative pressure surface of the blade 16 toward the main plate 14, thus suppressing the development of the horseshoe vortex. This further reduces the size of a relatively small horseshoe vortex that is produced in the vicinity of the positive pressure surface of the blade 16. Accordingly, the influence on the airflow moving along the blade 16 is reduced, and the air blowing performance is further improved. As a result, the curved portion R close to the side plate 15 and the curved projecting surface portion Q close to the main plate 14 produce a synergetic effect of a dead water region reducing action and a horseshoe vortex suppressing action. This further effectively improves the air blowing performance.

(Modification)

Figure 11:
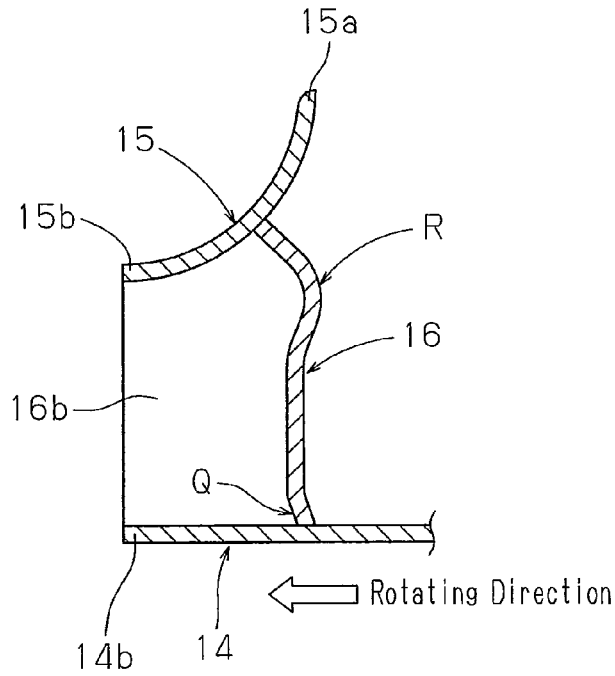
FIG. 11 is a cross-sectional view showing a portion of a modification having a blade with a reversed curvature.

As illustrate in FIG. 11, in the manner opposite to the above-described configuration, the curved projecting surface portion Q may be formed by projecting the leading edge 16*a* of each blade 16 in the rotating direction. In this configuration, Coriolis force produced by the rotation of the turbofan acts in the vicinity of the positive pressure surface of the blade 16. This further effectively suppresses the generation of a horseshoe vortex. As a result, the horseshoe vortex produced in the vicinity of the negative pressure surface of the blade 16 is also effectively suppressed. This reduces the influence on the airflow flowing along the blade 16, thus further effectively improving the air blowing performance.

Third Embodiment

A centrifugal fan according to a third embodiment of the present invention, which is employed in an indoor unit of a ceiling embedded air conditioner, will hereafter be described with reference to FIG. 12.

Figure 12:
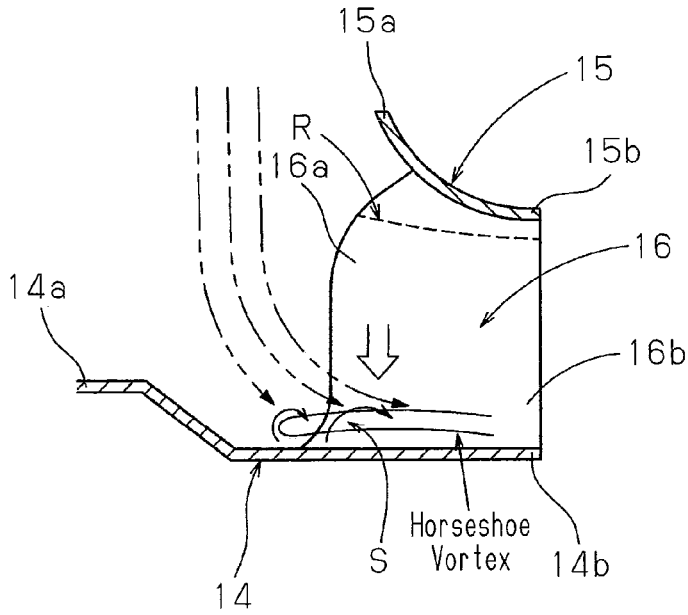
FIG. 12 is a cross-sectional view showing a main portion of a centrifugal fan according to a third embodiment of the present invention.

As illustrated in FIG. 12, the third embodiment is characterized in that a horseshoe vortex suppressing portion, which is similar to that of the second embodiment, is formed by a forward-swept blade structure S. The forward-swept blade structure S is formed by projecting a portion of the leading edge 16*a* of each blade 16 close to the main plate 14 toward the center of the main plate 14 by a predetermined dimension.

In this configuration, as represented by the arrows of phantom lines in FIG. 12, a drawn airflow (a main airflow) applies pressing force to both surfaces of each blade 16 at the joint portion between the leading edge 16*a* of the blade 16 and the main plate 14. This either makes it difficult for a horseshoe vortex to be generated or reduces the size of the horseshoe vortex. This decreases the influence on the airflow moving along the blade 16, thus effectively improving the air blowing performance. The other portions of the third embodiment such as the curved portion R close to the side plate 15 are configured in the same manners as the corresponding portions of the first embodiment.

(Modification)

A portion of the leading edge 16*a* of each blade 16 close to the main plate 14 projects toward the center of the main plate 14. In addition, as in the second embodiment and the modification thereof, the projecting portion may be inclined and curved in the rotating direction of the blade 16 or the direction opposite to the rotating direction of the blade 16. This configuration produces a synergetic effect of the horseshoe vortex suppressing action, which further effectively reduces the size of the horseshoe vortex.

Fourth Embodiment

A centrifugal fan according to a fourth embodiment of the present invention, which is used in an indoor unit of a ceiling embedded air conditioner, will now be explained with reference to FIG. 13.

Figure 13:
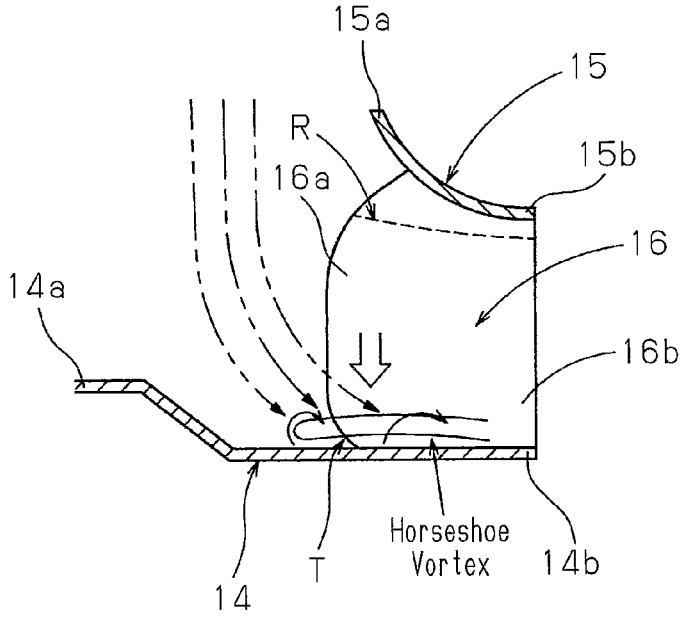
FIG. 13 is a cross-sectional view showing a main portion of a centrifugal fan according to a fourth embodiment of the invention.

As illustrated in FIG. 13, the fourth embodiment is characterized in that a horseshoe vortex suppressing portion is formed by a retreating blade structure T. The retreating blade structure T is formed by recessing the portion of the leading edge 16*a* of each blade 16 close to the main plate 14.

This configuration produces such a pressure gradient that an airflow toward the main plate 14 is generated with respect to the joint portion of the leading edge 16*a* of the blade 16 with respect to the main plate 14. This either makes it difficult for a horseshoe vortex to be generated or reduces the size of the horseshoe vortex. As a result, the influence on the airflow moving along the blade 16 is reduced, and the air blowing performance is improved effectively. Other portions of the fourth embodiment such as the curved portion R close to the side plate 15 are configured in the same manners as the corresponding portions of the first embodiment.

(Modification)

A portion of the leading edge 16*a* of each blade 16 close to the main plate 14 is recessed. In addition, as in the second embodiment and the modification thereof, the recessed portion may be inclined and curved in the rotating direction of the blade 16 or in the direction opposite to the rotating direction of the blade 16. This configuration produces a synergetic effect of the horseshoe vortex suppressing action, thus further effectively reducing the horseshoe vortex.

Fifth Embodiment

Figure 14:
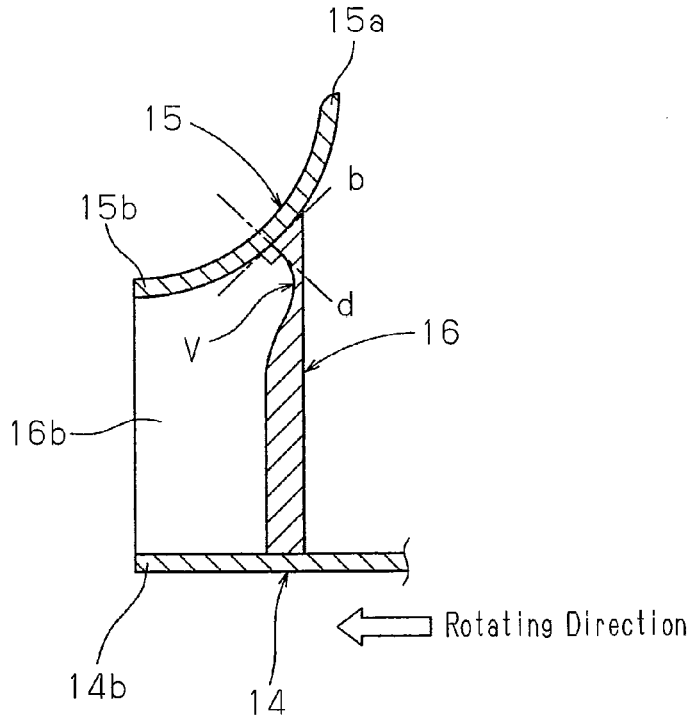
FIG. 14 is a cross-sectional view showing a main portion of a centrifugal fan according to a fifth embodiment of the invention.
Figure 15:
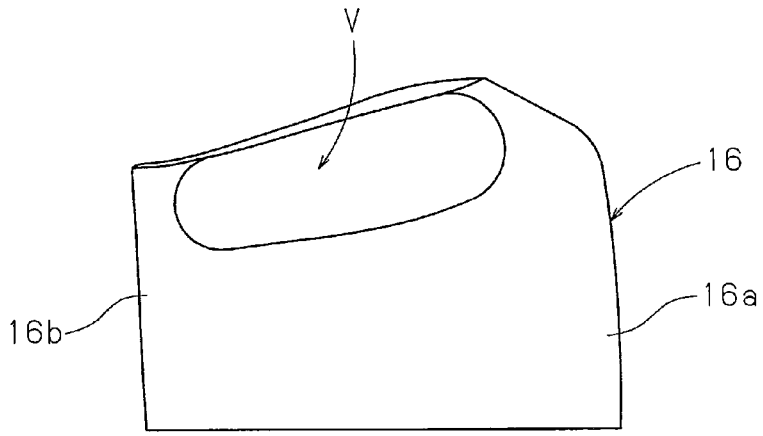
FIG. 15 is a side view showing a blade.

A centrifugal fan according to a fifth embodiment of the present invention, which is used in an indoor unit of a ceiling embedded air conditioner, will now be explained with reference to FIGS. 14 and 15.

In the fifth embodiment, each blade 16 extends linearly from the main plate 14 in a vertical direction and is joined to the inner arcuate surface of the side plate 15. However, as illustrated in FIGS. 14 and 15, a smooth recessed portion V, which extends from a leading edge toward a trailing edge of each blade 16 by a predetermined width, is formed in the end of the blade 16 joined to the side plate 15. This increases the interval between the airflow guide surface of the side plate 15 and the pressure surface of the blade 16.

In this configuration, a sufficiently large air passage is formed between the airflow guide surface of the side plate 15 and the pressure surface of each blade 16 as a dead water region reducing space. This produces a smooth airflow between both surfaces of the blade 16, which receive positive pressure and negative pressure. The blade performance, that is, the air blowing performance, is thus improved. Also, it is unnecessary to perform complicated bending of each blade 16 when shaping the blade 16. Further, by decreasing the thickness of the blade 16 and reducing the weight of the blade 16, the same advantages as the advantages of the first embodiment are obtained. In addition, with reference to FIG. 14, an upper surface of the recessed portion V of the blade 16 is joined to the inner arcuate surface of the side plate 15. Specifically, the upper surface of the recessed portion V is joined to the side plate 15 in such a manner that the tangential line d of the upper surface of the recessed portion V extends substantially perpendicular to the tangential line b of the inner arcuate surface of the side plate 15 on a plane including the rotational axis of the fan motor.

Sixth Embodiment

A centrifugal fan according to a sixth embodiment of the present invention, which is used in an indoor unit of a ceiling embedded air conditioner, will hereafter be explained with reference to FIG. 16.

In the sixth embodiment, each blade 16 extends linearly from the main plate 14 in a vertical direction and is joined to the inner arcuate surface of the side plate 15. However, with reference to FIG. 16, a smooth arcuate surface X, which extends from the leading edge 16*a* to the trailing edge 16*b* by a predetermined width, is formed in the end of the blade 16 joined to the side plate 15. This increases the interval between the airflow guide surface of the side plate 15 and the pressure surface of the blade 16.

In this configuration, a sufficiently large air passage is formed between the airflow guide surface of the side plate 15 and the pressure surface of each blade 16 as a dead water region reducing space. This produces a smooth airflow between both surfaces of the blade 16, which receive positive pressure and negative pressure. The blade performance, that is, the air blowing performance, is thus improved.

Figure 16:
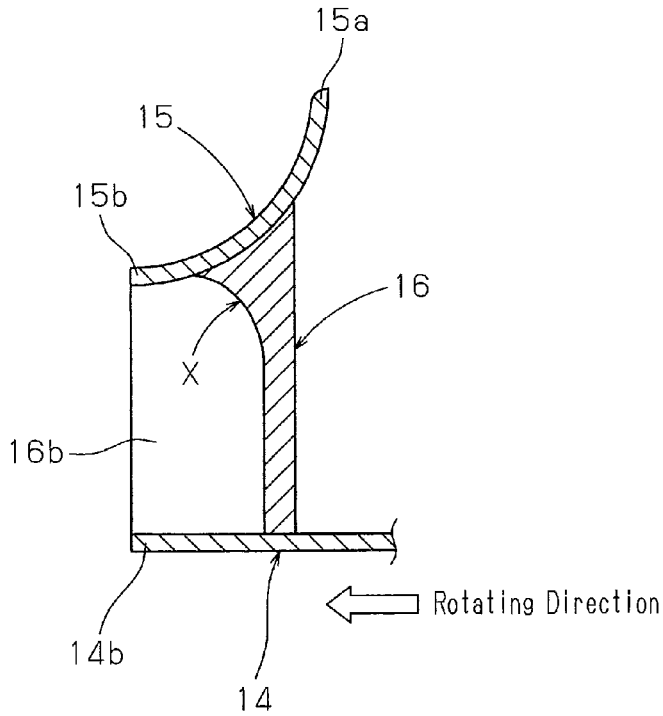
FIG. 16 is a cross-sectional view showing a main portion of a centrifugal fan according to a sixth embodiment of the present invention.

Further, with reference to FIG. 16, the inner arcuate surface X of each blade 16 is joined to the inner arcuate surface of the side plate 15. Specifically, the inner arcuate surface X of the blade 16 is joined to the side plate 15 in such a manner that a tangential line of the arcuate surface X extends substantially perpendicular to a tangential line of the inner arcuate surface of the side plate 15 on a plane including the rotational axis of the fan motor. Since the relationship between the tangential lines is the same as the relationship between the tangential lines illustrated in FIG. 14, the relationship is not illustrated in the drawing.

Seventh Embodiment

A centrifugal fan according to a seventh embodiment of the present invention, which is employed in an indoor unit of a ceiling embedded air conditioner, will hereafter be described with reference to FIG. 17.

Figure 17:
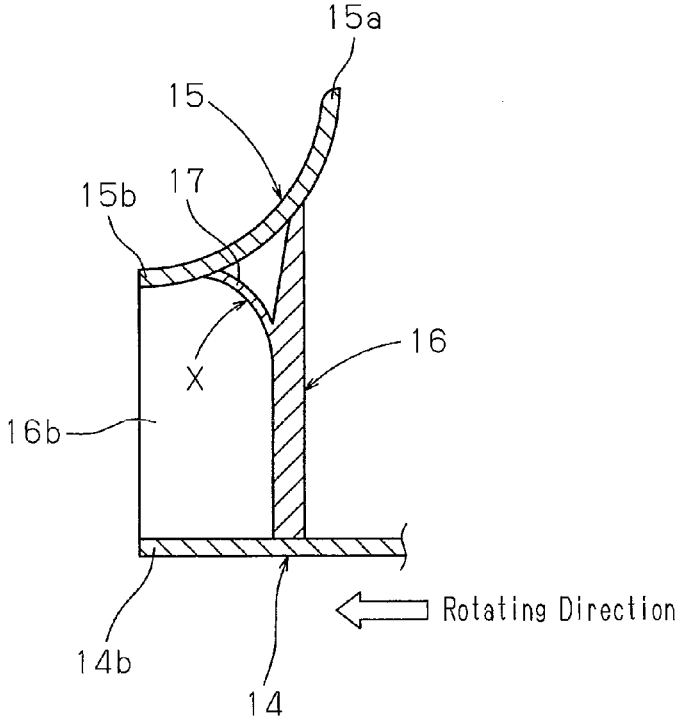
FIG. 17 is a cross-sectional view showing a main portion of a centrifugal fan according to a seventh embodiment of the invention.

In the seventh embodiment, as illustrated in FIG. 17, an arcuate surface X, which is similar to that of the blade 16 of the sixth embodiment, is formed in each blade 16. In addition, the end of the blade 16 joined to the side plate 15 is bifurcated. This forms a space having a Y-shaped cross section and a fillet 17 having an arcuate cross section in the end of the blade 16. The blade 16 is joined to the inner arcuate surface of the side plate 15 through the fillet 17. This configuration ensures the same advantages as the advantages of the sixth embodiment without increasing the weight of each blade 16 compared to the sixth embodiment.

Eighth Embodiment

Figure 18:
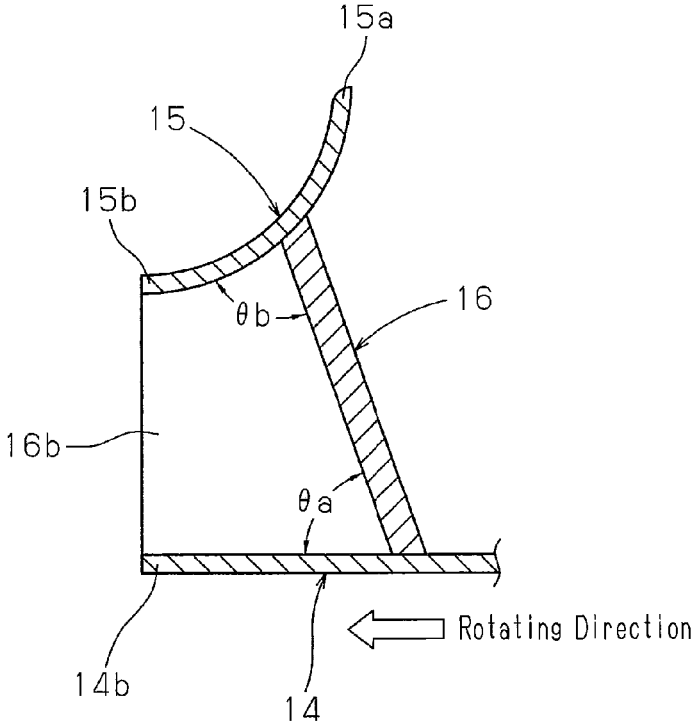
FIG. 18 is a cross-sectional view showing a main portion of a centrifugal fan according to an eighth embodiment of the invention.

A centrifugal fan according to an eighth embodiment of the present invention, which is used in an indoor unit of a ceiling embedded air conditioner, will now be described with reference to FIG. 18.

In the eighth embodiment, each blade 16 extends linearly from the main plate 14 in a vertical direction and is joined to the inner arcuate surface of the side plate 15. However, since the interior angle θa of the blade 16 with respect to the main plate 14 is smaller than 90°, the interior angle θb of the joint portion between the end of the blade 16 and the side plate 15 is substantially or approximately 90°, as illustrated in FIG. 18. This increases the interval between the airflow guide surface of the side plate 15 and the pressure surface of the blade 16.

In this configuration, a sufficiently large air passage is formed between the airflow guide surface of the side plate 15 and the pressure surface of each blade 16 as a dead water region reducing space. This produces a smooth airflow between both surfaces of the blade 16, which receive positive pressure and negative pressure. The blade performance, that is, the air blowing performance, is thus improved. Also, it is unnecessary to perform complicated bending of each blade 16 when forming the blade 16. Accordingly, the manufacturing costs are reduced.

Ninth Embodiment

Figure 19:
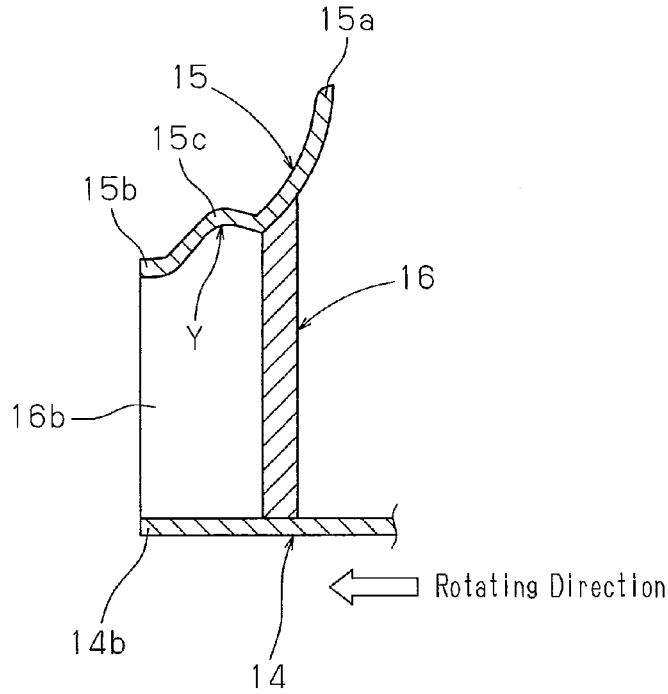
FIG. 19 is a cross-sectional view showing a main portion of a centrifugal fan according to a ninth embodiment of the invention.
Figure 20:
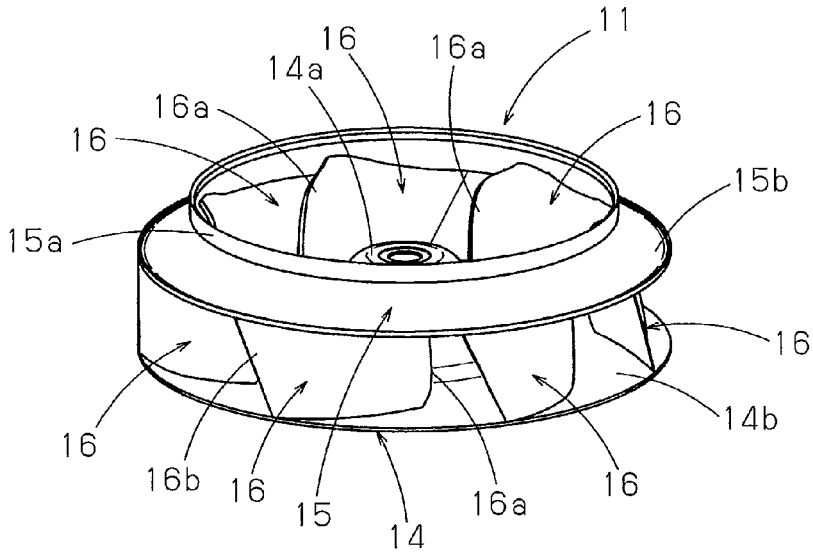
FIG. 20 is a perspective view showing the configuration of a centrifugal fan, as a whole, according to a tenth embodiment of the invention.
Figure 21:
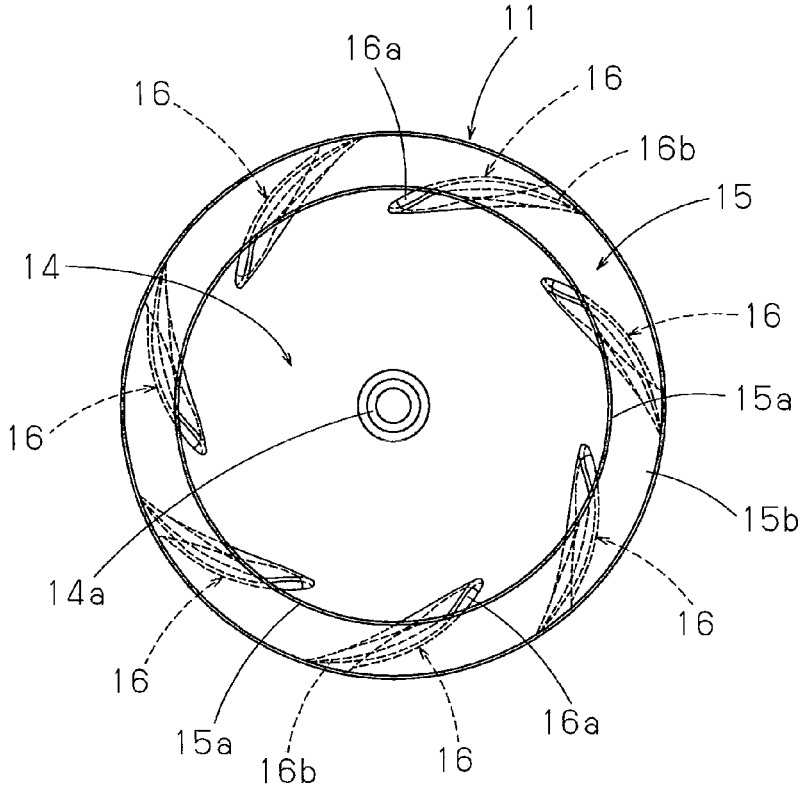
FIG. 21 is a plan view showing the centrifugal fan as viewed from a side corresponding to a side plate (a shroud)
Figure 22:
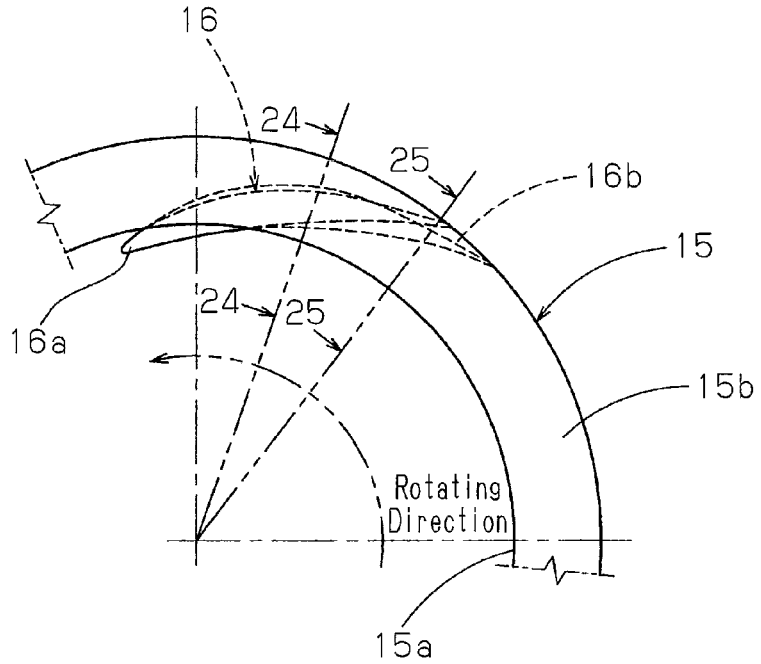
FIG. 22 is an enlarged plan view showing a portion of a blade and a portion of a side plate portion of the centrifugal fan.
Figure 23:
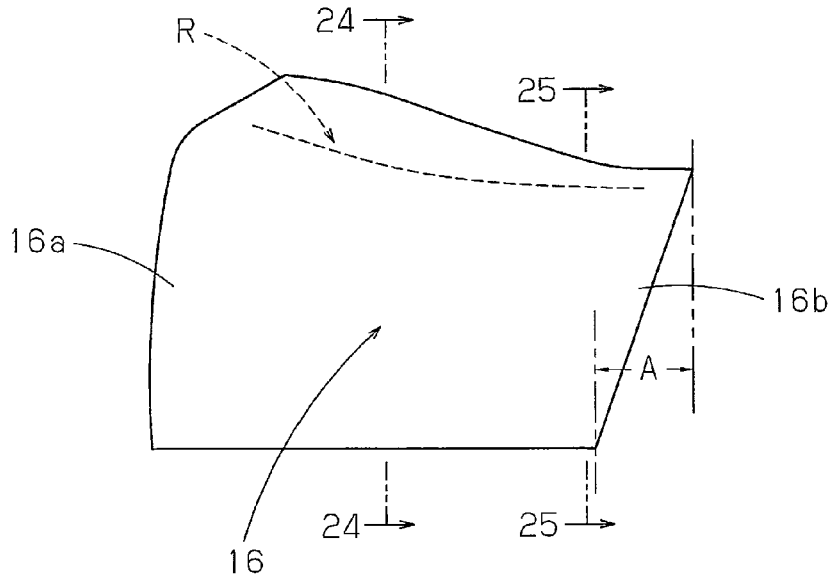
FIG. 23 is a side view showing a blade portion.
Figure 24:
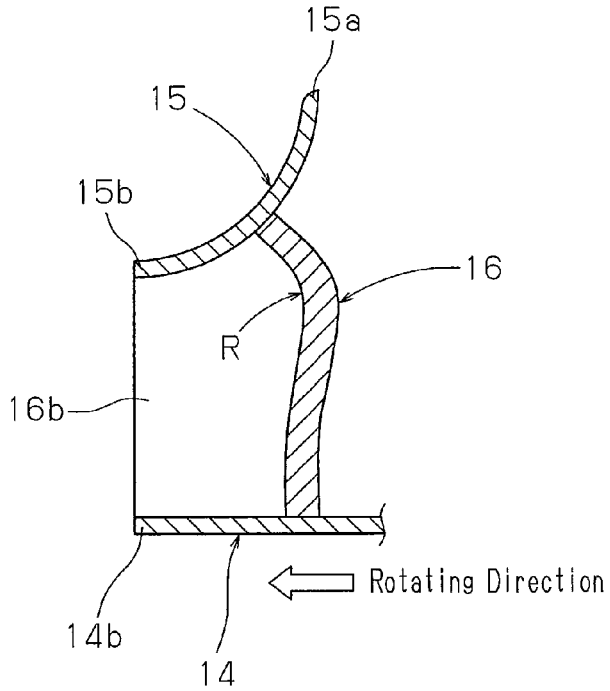
FIG. 24 is a cross-sectional view taken along line 24-24 of FIGS. 22 and 23.
Figure 25:
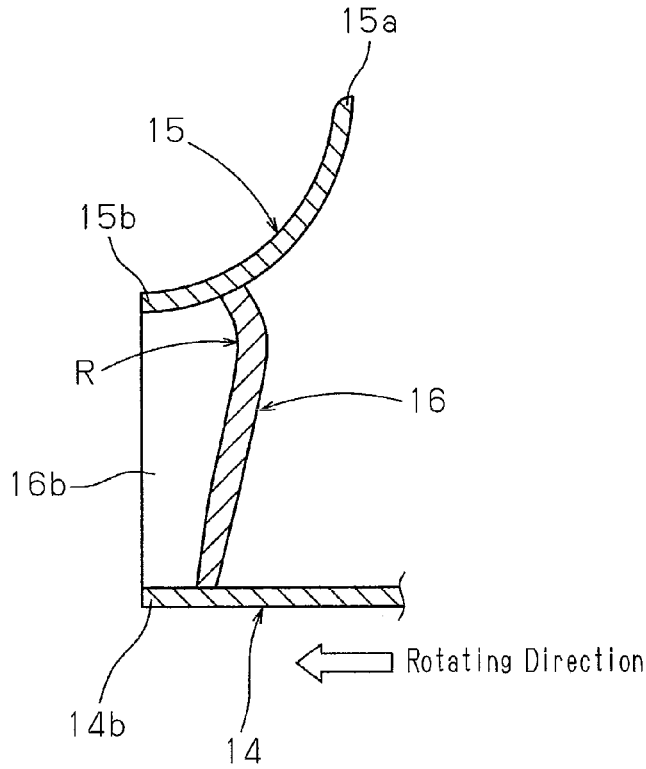
FIG. 25 is a cross-sectional view taken along line 25-25 of FIGS. 22 and 23.

A ceiling fan according to a ninth embodiment of the present invention, which is employed in an indoor unit of a ceiling embedded air conditioner, will now be explained with reference to FIG. 19.

In the ninth embodiment, each blade 16 extends perpendicular to and linearly from the main plate 14 and is joined to the inner arcuate surface of the side plate 15. However, as illustrated in FIG. 19, a curved portion 15*c*, which has a predetermined width and extends toward the bellmouth 6, is formed in the side plate 15 joined to the blade 16. This forms a curved surface Y, which increases the passage area, in the inner side of the side plate 15. Accordingly, the interval between the airflow guide surface of the side plate 15 and the pressure surface of each blade 16 is increased.

In this configuration, a sufficiently large air passage is formed between the airflow guide surface of the side plate 15 and the pressure surface of each blade 16 as a dead water region reducing space. This produces a smooth airflow between both surfaces of the blade 16, which receive positive pressure and negative pressure. The blade performance, that is, the air blowing performance, is thus improved.

Tenth Embodiment

A centrifugal fan according to a tenth embodiment of the present invention, which is used in an indoor unit of a ceiling embedded air conditioner, will hereafter be explained with reference to FIGS. 20 to 27.

The tenth embodiment is different from the first embodiment in that the attachment position of the trailing edge 16*b* of each blade 16 with respect to the side plate 15 is offset from the attachment position of the trailing edge 16*b* to the main plate 14 in the direction opposite to the rotating direction of the blade 16. Also, the trailing edge 16*b* of the blade 16 is gradually displaced from the main plate 14 toward the side plate 15 in the direction opposite to the rotating direction.

In the tenth embodiment, each blade 16 has the curved portion R and thus exerts a dead water region reducing action, like the first embodiment. In addition, as illustrated in FIGS. 21 to 25, the trailing edge 16*b* of the blade 16 is attached to the arcuate surface of the side plate 15 with the attachment position of the trailing edge 16*b* to the side plate 15 located offset from the attachment position of the trailing edge 16*b* to the main plate 14 by a predetermined dimension A in the direction opposite to the rotating direction of the blade 16 (see, particularly, FIGS. 23 to 25). In this manner, by setting the attachment position of the trailing edge 16*b* of each blade 16 to the side plate 15 offset from the attachment position of the trailing edge 16*b* to the main plate 14 in the direction opposite to the rotating direction, the speed of the airflow is distributed uniformly in an outlet portion of the blade 16. Accordingly, not only the air blowing performance is improved by the dead water region reducing space formed by the curved portion R but also the fan noise is further effectively decreased by arranging the trailing edge 16*b* in the offset manner.

Figure 26:
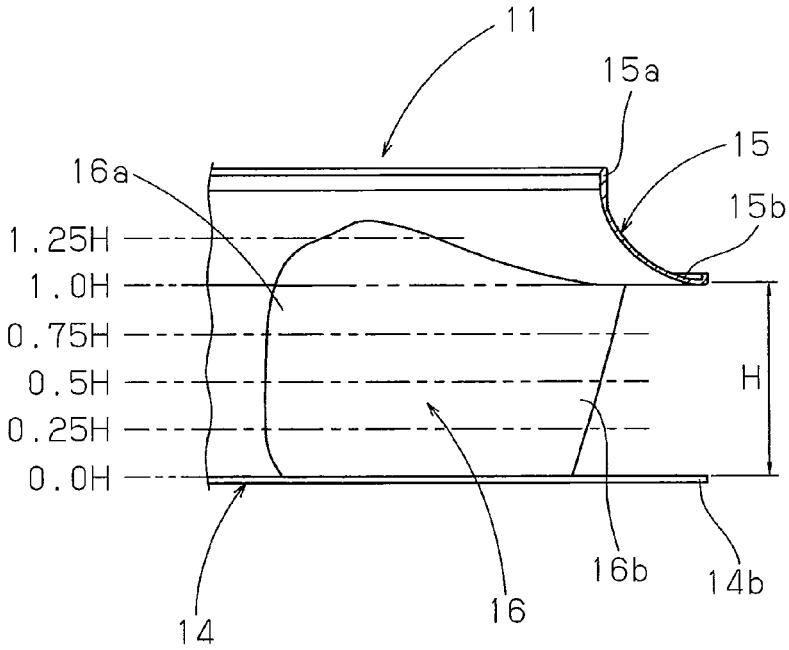
FIG. 26 illustrates various sections of a blade portion being spaced apart by a width of 0.25 H.
Figure 27:
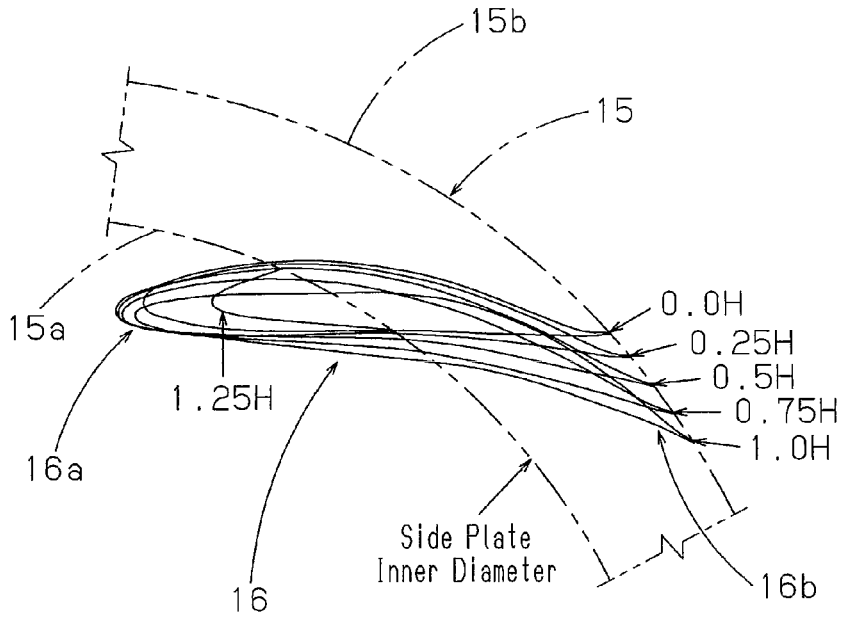
FIG. 27 is a diagram schematically showing the cross sectional shape of the blade portion along cut positions illustrated in FIG. 26.

Further, with reference to FIGS. 26 and 27, the trailing edge 16*b* of each blade 16 is gradually displaced from the main plate 14 toward the side plate 15 in the direction opposite to the rotating direction. FIG. 27 illustrates changes of the cross-sectional shape of the blade 16 when sliced at five sections spaced by a width of 0.25H from the main plate 14 toward the side plate 15 as illustrated in FIG. 26. As is clear from FIG. 27, the trailing edge 16*b* of the blade 16 is displaced offset continuously in the direction opposite to the rotating direction. The span dimension H is equal to the height of the trailing edge 16*b* of each blade 16.

Specifically, the attachment position of the trailing edge 16*b* of each blade 16 to the side plate 15 is displaced from the attachment position of the trailing edge 16*b* to the main plate 14 in the direction opposite to the rotating direction. Further, the trailing edge 16*b* of the blade 16 is gradually displaced in the direction opposite to the rotating direction from the main plate 14 toward the side plate 15. Accordingly, the speed of the airflow is distributed further uniformly in the outlet portion of each blade 16 and the fan noise is further effectively decreased.

Eleventh Embodiment

A centrifugal fan according to an eleventh embodiment of the present invention, which is employed in an indoor unit of a ceiling embedded air conditioner, will hereafter be explained with reference to FIG. 28.

Figure 28:
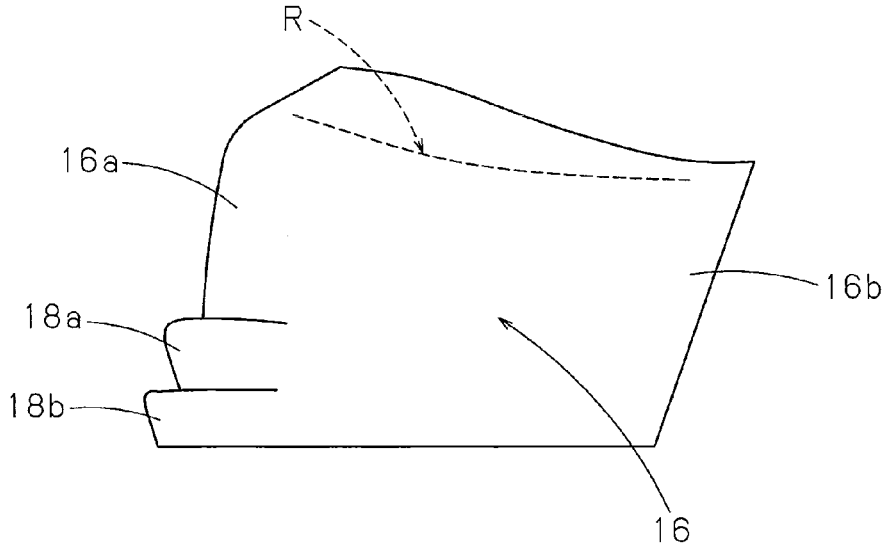
FIG. 28 is a side view showing a blade of a centrifugal fan according to an eleventh embodiment of the present invention.

As illustrated in FIG. 28, in the eleventh embodiment, a plurality of stepped portions projecting upstream with different lengths, which are a first stepped portion 18*a* and a second stepped portion 18*b*, are formed in a portion of the leading edge 16*a* of each blade 16 close to the main plate 14.

In this configuration, an airflow heading toward the leading edge 16*a* of the blade 16 becomes turbulent by hitting the discontinuous portion formed by the first and second stepped portions 18*a*, 18*b*. A vertical vortex in the drawn air is guided by the stepped surfaces of the first and second stepped portions 18*a*, 18*b* and generated in a concentrated manner on the outer peripheral surface or the inner peripheral surface of the blade 16. As a result, the vertical vortex develops and produces an intense energy. The thus produced vertical vortex effectively suppresses separation of the airflow from the outer peripheral surface or the inner peripheral surface of the blade 16. Accordingly, the fan noise is reliably reduced.

Twelfth Embodiment

A centrifugal fan according to a twelfth embodiment of the present invention, which is used in an indoor unit of a ceiling embedded air conditioner, will now be described with reference to FIG. 29.

Figure 29:
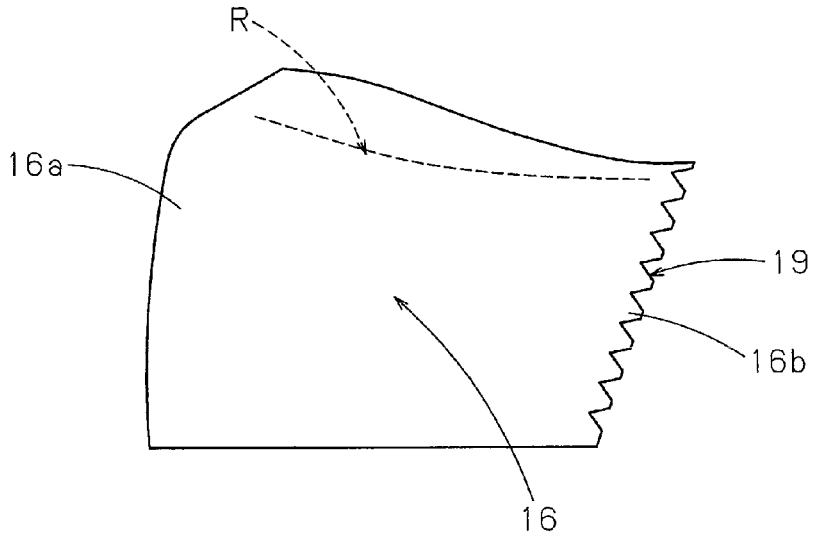
FIG. 29 is a side view showing a blade of a centrifugal fan according to a twelfth embodiment of the invention.

As illustrated in FIG. 29, the twelfth embodiment includes a sawtooth shaped portion 19, which is formed in the trailing edge 16*b* of each blade 16. The sawtooth shaped portion 19 subdivides the airflows moving along the two blade surfaces at the trailing edge 16*b* of the blade 16. This reduces the turbulence in the airflows caused at the time when the airflows moving along the two blade surfaces meet each other, thus minimizing the fan noise produced in the trailing edge 16*b* of the blade 16. In this case, the sawtooth shaped portion 19 may be shaped as publicly known serrations.

Thirteenth Embodiment

A centrifugal fan according to a thirteenth embodiment of the present invention, which is employed in an indoor unit of a ceiling embedded air conditioner, will now be described with reference to FIG. 30.

Figure 30:
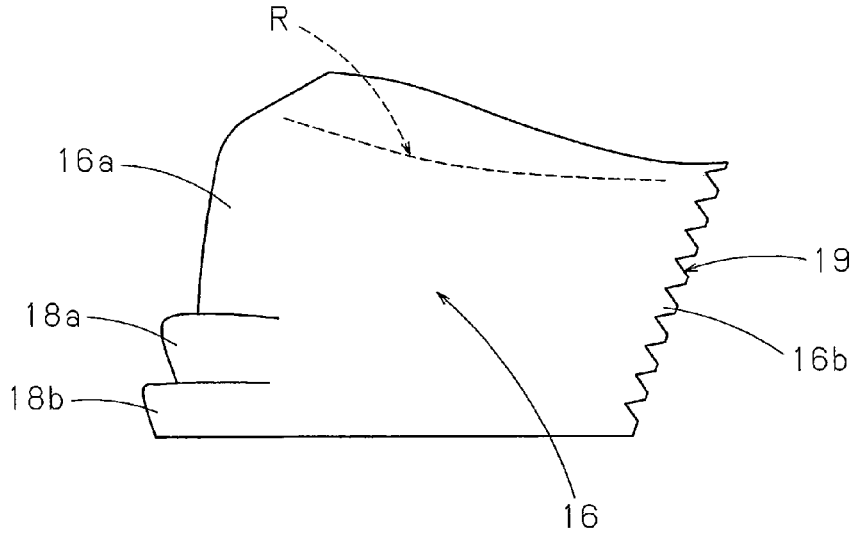
FIG. 30 is a side view showing a blade of a centrifugal fan according to a thirteenth embodiment of the invention.

As illustrated in FIG. 30, the thirteenth embodiment is characterized in that the first and second stepped portions 18*a*, 18*b* illustrated in FIG. 28 are formed in a portion of the leading edge 16*a* of the blade 16 of the first embodiment close to the main plate 14. The thirteenth embodiment is characterized also in that the sawtooth shaped portion 19 illustrated in FIG. 29 is formed in the trailing edge 16*b* of the blade 16.

In this configuration, an airflow flowing toward the leading edge 16*a* of the blade 16 becomes turbulent by striking the discontinuous portion formed by the first and second stepped portions 18*a*, 18*b*. A vertical vortex in the drawn air is guided by the stepped surfaces of the first and second stepped portions 18*a*, 18*b* and generated in a concentrated manner on the outer peripheral surface or the inner peripheral surface of the blade 16. As a result, the vertical vortex develops and produces an intense energy. The thus produced vertical vortex effectively suppresses separation of the airflow from the outer peripheral surface or the inner peripheral surface of the blade 16. Accordingly, the fan noise is reliably reduced.

Further, the sawtooth shaped portion 19, which is formed in the trailing edge 16*b* of each blade 16, subdivides the airflows moving along the two blade surfaces at the trailing edge 16*b* of the blade 16. This reduces the turbulence in the airflows caused at the time when the airflows moving along the two blade surfaces meet each other, thus minimizing the fan noise produced in the trailing edge 16*b* of the blade 16.

OTHER EMBODIMENTS

The configurations of the tenth to thirteenth embodiments may be employed in the blades 16 of the second to ninth embodiments, in addition to the blade 16 of the first embodiment.

The invention claimed is:

1. A centrifugal fan comprising:

a circular main plate driven and rotated by a motor rotary shaft;

a plurality of blades fixed to an outer circumferential portion of the main plate and spaced apart at predetermined intervals in a circumferential direction of the main plate; and a side plate attached to ends of the blades opposite to the main plate, an air inlet port being formed at a center of the side plate, the side plate inclining outward in a centrifugal direction from the air inlet port, the side plate having an arcuate cross section with a predetermined radius of curvature, wherein the centrifugal fan includes a dead water region reducing space that is formed between each of the blades and the side plate, the dead water region reducing space extending from a leading edge of each blade to a trailing edge of the blade, wherein a portion of each blade is bent in a direction opposite to a rotating direction, the blade being joined to an arcuate surface of the side plate with the bent portion, thereby forming the dead water region reducing space between the blade and the side plate, and wherein the bent portion projects in the direction opposite to the rotating direction with respect to a line, which extends from the joint portion between the blade and the main plate along an axis of the motor rotary shaft, on a plane including the axis of the motor rotary shaft.

2. The centrifugal fan according to claim 1, wherein each of the blades are joined to the side plate at an end of the blade close to the side plate in such a manner that the angle of the corner formed between one surface of each blade and the side plate becomes substantially equal to the angle of the corner formed between the other surface of the blade and the side plate, thereby forming the dead water region reducing space between the blade and the side plate that extends from the leading edge of the blade and the trailing edge of the blade.

3. The centrifugal fan according to claim 1 or 2, wherein, in a plane including the motor rotary shaft, each blade is joined to the arcuate surface of the side plate in such a manner that a midline of the blade extending from the main plate to the side plate is substantially perpendicular to a tangential line of the arcuate surface of the side plate.

4. The centrifugal fan according to claim 1, wherein the bent portion is arranged at a position close to the side plate with respect to the middle between the main plate and the side plate.

5. The centrifugal fan according to claim 1, wherein each blade is arranged with the leading edge facing the center of the main plate and the trailing edge facing an outer circumference of the main plate, wherein an attachment position of the trailing edge of the blade to the side plate is offset from an attachment position of the trailing edge of the blade to the main plate in the direction opposite to the rotating direction.

6. The centrifugal fan according to claim 1, wherein each blade is arranged with the leading edge facing the center of the main plate and the trailing edge facing the outer periphery of the main plate, wherein the trailing edge of the blade is gradually displaced in the direction opposite to the rotating direction from the main plate toward the side plate.

7. The centrifugal fan according to claim 1, wherein each blade is arranged with the leading edge facing the center of the main plate and the trailing edge facing the outer periphery of the main plate, wherein the trailing edge of the blade is formed in a sawtooth-like shape.

8. The centrifugal fan according to claim 1, wherein each blade is arranged with the leading edge facing the center of the main plate and the trailing edge facing the outer periphery of the main plate, wherein a portion of the leading edge of the blade close to the main plate is formed in a stepped shape.

9. The centrifugal fan according to claim 1, wherein each blade has a horseshoe vortex suppressing portion, the horseshoe vortex suppressing portion being formed by curving a portion of the leading edge of the blade close to the main plate such that the portion projects in the rotating direction.

10. The centrifugal fan according to claim 1, wherein each blade has a horseshoe vortex suppressing portion, the horseshoe vortex suppressing portion being formed by curving a portion of the leading edge of the blade close to the main plate such that the portion projects in the direction opposite to the rotating direction.

11. The centrifugal fan according to claim 1, wherein each blade has a forward-swept blade structure, the forward-swept blade structure being formed by projecting a portion of the leading edge of the blade close to the main plate toward the center of the main plate.

12. The centrifugal fan according to claim 1, wherein each blade has a retreating blade structure, the retreating blade structure being formed by recessing a portion of the leading edge of the blade close to the main plate.

* * * * *